US008369728B2

(12) United States Patent
Kato et al.

(10) Patent No.: US 8,369,728 B2
(45) Date of Patent: Feb. 5, 2013

(54) IMAGE FORMING APPARATUS

(75) Inventors: Masanori Kato, Kanagawa (JP); Junichi Hama, Kanagawa (JP); Satoshi Tanaka, Kanagawa (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 277 days.

(21) Appl. No.: 12/941,490

(22) Filed: Nov. 8, 2010

(65) Prior Publication Data

US 2011/0255887 A1 Oct. 20, 2011

(30) Foreign Application Priority Data

Apr. 16, 2010 (JP) ..... 2010-095285

(51) Int. Cl.
*G03G 15/06* (2006.01)

(52) U.S. Cl. ..... 399/55; 399/30; 399/43; 399/44

(58) Field of Classification Search ..... 399/30, 399/43, 44, 55

See application file for complete search history.

(56) References Cited

U.S. PATENT DOCUMENTS

2006/0018674 A1* 1/2006 Hirata et al. ..... 399/29
2008/0232830 A1* 9/2008 Tanaka ..... 399/30

FOREIGN PATENT DOCUMENTS

JP 07295373 A * 11/1995
JP 2007-86332 A 4/2007
JP 2008-122537 A 5/2008

* cited by examiner

*Primary Examiner* — David Gray
*Assistant Examiner* — G. M. Hyder
(74) *Attorney, Agent, or Firm* — Sughrue Mion, PLLC

(57) ABSTRACT

An image forming apparatus includes a latent image holder that holds a latent image; a developing unit that contains developer including toner particles and carrier particles, develops a latent image with the toner particles, and forms a toner image; a voltage applying unit that applies a voltage to the developing unit; a toner concentration detection unit that detects a toner concentration that is a proportion of the toner particles to the developer contained in the developing unit; and a setting unit that sets a setting value of the voltage on the basis of the toner concentration detected by the toner concentration detection unit, the voltage being applied by the voltage applying unit to the developing unit, wherein a difference between an upper limit and a lower limit of the set value increases as the toner concentration increases, the set value being set by the setting unit.

8 Claims, 5 Drawing Sheets

IMAGE FORMING APPARATUS

CROSS-REFERENCE TO RELATED APPLICATIONS

This application is based on and claims priority under 35 USC 119 from Japanese Patent Application No. 2010-095285 filed Apr. 16, 2010.

BACKGROUND

The present invention relates to an image forming apparatus.

SUMMARY

According to an aspect of the invention, an image forming apparatus includes a latent image holder that holds a latent image; a developing unit that contains developer including toner particles and carrier particles, develops a latent image with the toner particles, and forms a toner image; a voltage applying unit that applies a voltage to the developing unit; a toner concentration detection unit that detects a toner concentration that is a proportion of the toner particles to the developer contained in the developing unit; and a setting unit that sets a setting value of the voltage on the basis of the toner concentration detected by the toner concentration detection unit, the voltage being applied by the voltage applying unit to the developing unit, wherein a difference between an upper limit and a lower limit of the set value increases as the toner concentration increases, the set value being set by the setting unit.

BRIEF DESCRIPTION OF THE DRAWINGS

Exemplary embodiments of the present invention will be described in detail based on the following figures, wherein.

DETAILED DESCRIPTION

An example of an image forming apparatus according to a first exemplary embodiment of the present invention will be described.

Figure 1:
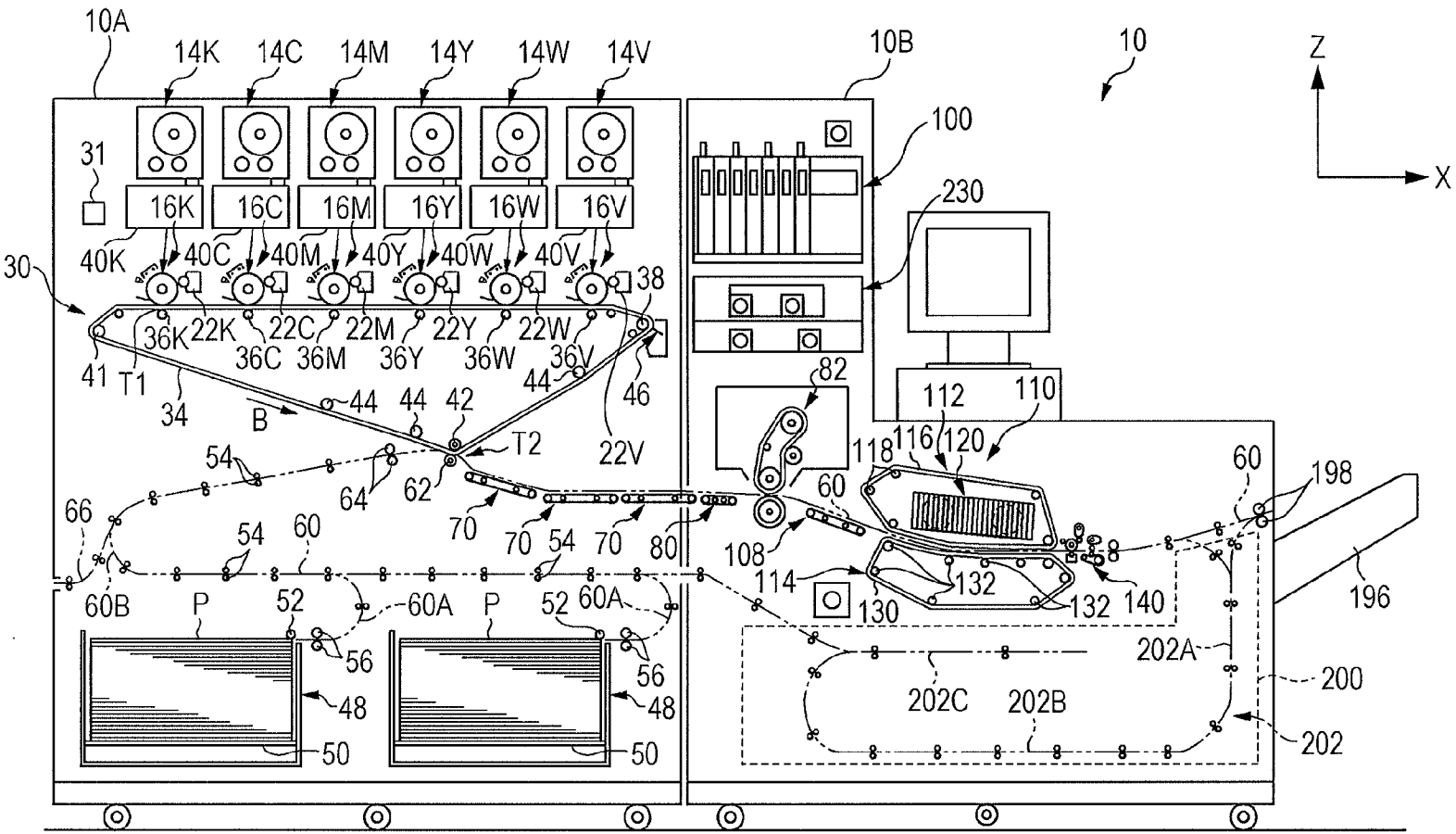
FIG. 1 is an overall view of an image forming apparatus according to a first exemplary embodiment of the present invention.

FIG. 1 illustrates an image forming apparatus 10 according to the first exemplary embodiment. The image forming apparatus 10, which forms a color image or a monochrome image, includes a first processing section 10A and a second processing section 10B. The first processing section 10A is disposed on the left side in a front view. The second processing section 10B is removable from the first processing section 10A and is disposed on the right side. The housings of the first processing section 10A and the second processing section 10B are made of plural frames.

A controller 100 is disposed in an upper part of the second processing section 10B with respect to the vertical direction (the direction of arrow Z). The controller 100 includes an image signal processor that performs image processing on image data that is sent from a computer. The controller 100, which is an example of a setting unit, controls driving of the components of the image forming apparatus 10. A power unit 230 is disposed below the controller 100. The power unit 230 converts an alternate current supplied from the outside to a direct current, and supplies the direct current to the components of the image forming apparatus 10.

Toner cartridges 14V, 14W, 14Y, 14M, 14C, and 14K, which respectively contain toner (developer) corresponding to a first specific color (V), a second specific color (W), yellow (Y), magenta (M), cyan (C), and black (K), are disposed in the upper part of the first processing section 10A with respect to the vertical direction. The toner cartridges, which are replaceable, are arranged in the horizontal direction. In the present exemplary embodiment, for example, two-component developer that includes toner and carrier is used. Polymerized toner, which is composed of spherical particles as compared with pulverized toner, is used as the toner. The polymerized toner is more likely to become cloud-like (be scattered) and more likely to agglomerate than the pulverized toner, in particular, when used in a high-speed machine that forms an image on a sheet P at high speed. Therefore, when the toner concentration is increased in order to increase the density of a toner image, the quality of the image is affected by toner scattering or the like. Accordingly, in particular when the polymerized toner is used, the upper limit of the toner concentration is to be managed.

The first specific color and the second specific color are selected from specific colors (including transparent) excluding yellow, magenta, cyan, and black. Clear toner, which is used for coating an image, is an example of the specific color toner. In the following description, one of the alphabets V, W, Y, M, C, and K is added to a numeral where it is necessary to identify a color. The alphabets V, W, Y, M, C, and K are omitted where it is not necessary to identify a color.

Below the toner cartridges 14, six image forming units 16 for respective colors are arranged in the horizontal direction so as to correspond to the toner cartridges 14. The image forming units 16 are arranged in the order of 16V, 16W, 16Y, 16M, 16C, and 16K in the direction in which an intermediate transfer belt 34 rotates (counterclockwise in FIG. 1). Below the toner cartridges 14, exposure units 40 for the respective image forming units 16 are disposed. Each of the exposure units 40 receives image data, which has been image processed, from the controller 100, modulates a semiconductor laser (not shown) in accordance with color gradation data, and emits an exposure light beam L from the semiconductor laser. To be specific, the exposure unit 40 irradiates a surface of a photoconductor 18 (described below, see FIG. 2) with the exposure light beam L that corresponds to each of the colors, and forms an electrostatic latent image on the photoconductor 18.

Figure 2:
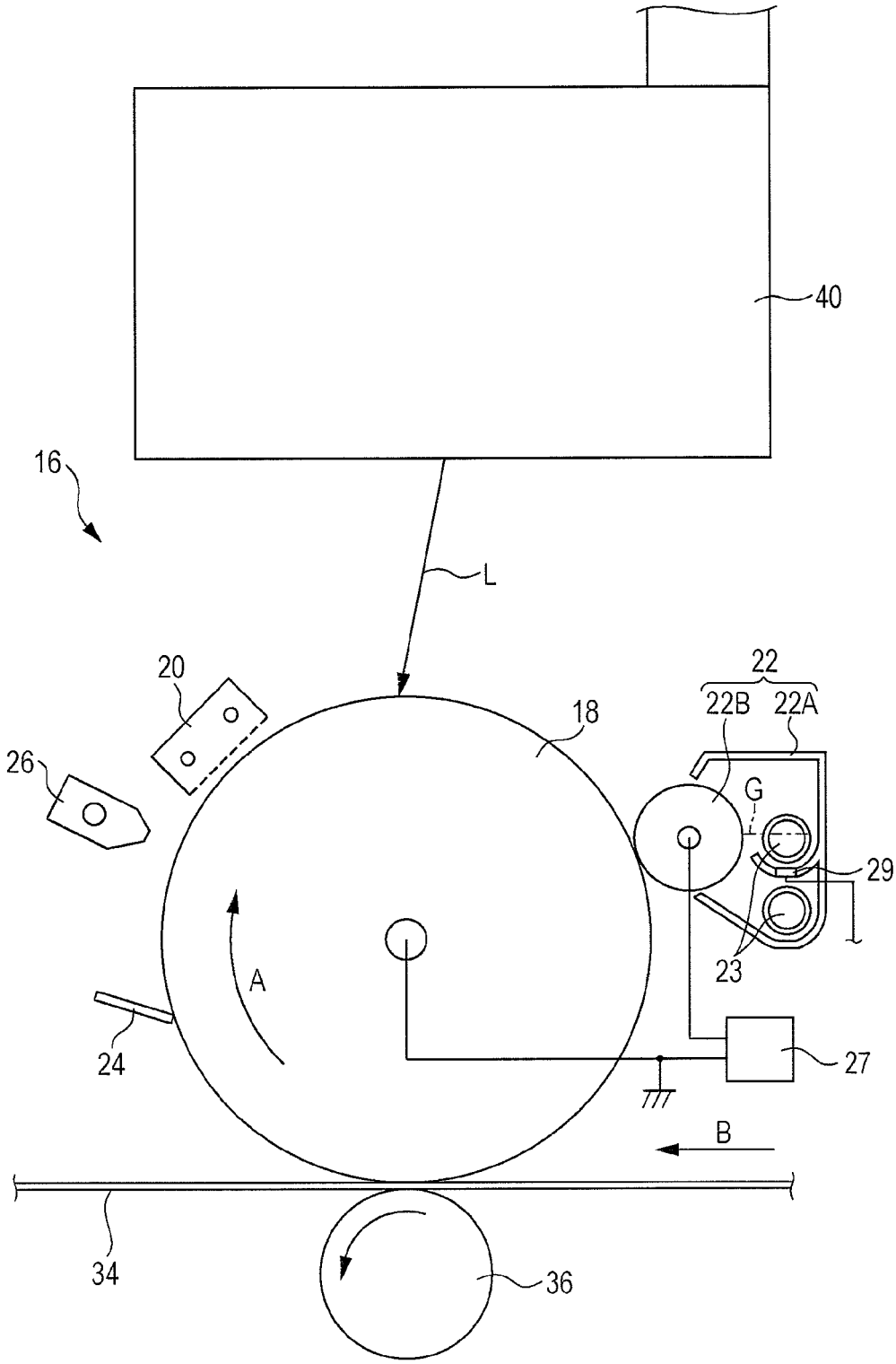
FIG. 2 is a schematic view of an image forming unit according to the first exemplary embodiment of the present invention.

As illustrated in FIG. 2, the image forming unit 16 includes the photoconductor 18 that rotates in the direction of arrow A (clockwise in FIG. 2). The photoconductor 18 is an example of a latent image holder. Around the photoconductor 18, a charger 20, a developing unit 22, a cleaning blade 24, and an erase lamp 26 are disposed. The charger 20, which is a corona-discharge type (non-contact type) charger, charges the photoconductor 18. The developing unit 22 develops an electrostatic latent image, which has been formed on the photoconductor 18 by the exposure light L emitted by the exposure unit 40, using developer (toner) of a corresponding color. The cleaning blade 24 cleans the surface of the photoconductor 18 after the transfer has been finished. The erase lamp 26 erases charge by irradiating the surface of the photoconductor 18 after the transfer has been finished. The charger 20, the developing unit 22, the cleaning blade 24, and the erase lamp 26, which face the surface of the photoconductor 18, are arranged in this order in the direction in which the photoconductor 18 rotates.

The developing unit 22 is disposed on a side of the image forming unit 16 (on the right side of FIG. 2 in the present exemplary embodiment). The developing unit 22 includes a developer container 22A, a development roller 22B, and two augers 23. The developer container 22A contains developer G including toner. The development roller 22B moves the toner contained in the developer container 22A to the surface of the photoconductor 18. The augers 23, which rotate in the developer container 22A, circulate the toner. The development roller 22B and the augers 23 are rotated by a motor (not shown), which is controlled by the controller 100 (see FIG. 1). The development roller 22B includes a cylindrical development sleeve (not shown) and a magnetic member disposed in the development sleeve. The development sleeve rotates.

The development roller 22B is electrically connected to a voltage applying section 27, which is an example of a voltage applying unit. The voltage applying section 27 is electrically connected to the development roller 22B and the photoconductor 18. The voltage applying section 27 applies a direct voltage or an alternating voltage (hereinafter referred to as a development bias voltage) to the development roller 22B. The photoconductor 18 is grounded. A potential difference is generated between the development roller 22B, to which the voltage applying section 27 applies a development bias voltage, and a latent image formed on the surface of the photoconductor 18. Because of the potential difference, the toner is moved from the outer peripheral surface of the development roller 22B to the outer peripheral surface (front surface) of the photoconductor 18, whereby development is performed.

One end of a dispenser (not shown) is connected to the developer container 22A. The dispenser includes a pipe and an auger (not shown). The other end of the dispenser is connected to the toner cartridge 14 (see FIG. 1). When the controller 100 (see FIG. 1) drives a motor (not shown) and rotates the auger, toner is supplied from the toner cartridge 14 through the dispenser to the developer container 22A.

A toner concentration sensor 29 is disposed on a side of the developer container 22A (a side between the upper and lower augers 23 and in a distal part in the axial direction). A detection portion of the toner concentration sensor 29 contacts the developer G that is contained in the developer container 22A. The toner concentration sensor 29 detects a toner concentration on the basis of a magnetic permeability that is detected by the detection portion. Information on the detected toner concentration is sent to the controller 100 (see FIG. 1). The developer G includes toner particles, which are mainly made of resin materials, and carrier particles, which are mainly made of magnetic materials. The term "toner concentration" refers to the proportion (%) of the amount of toner particles to the amount of developer G contained in the developer container 22A.

As illustrated in FIG. 1, a transfer device 30 is disposed below the image forming units 16. Details of the transfer device 30 will be described below. Two sheet feed cassettes 48 are disposed below the transfer device 30 and in a lower part of the first processing section 10A. The sheet feed cassettes 48 are arranged in the horizontal direction (the direction of arrow X), have a large size, and are capable of containing a large number of sheets P. Because the sheet feed cassettes 48 have the same structure, one of the sheet feed cassettes 48 will be described, and the other of the sheet feed cassettes 48 will not be described.

Each of the sheet feed cassettes 48 may be pulled out of the first processing section 10A. When the sheet feed cassette 48 is pulled out of the first processing section 10A, a bottom plate 50, which is disposed in the sheet feed cassette 48 and on which the sheets P are placed, is lowered under the command of a control unit (not shown). When the bottom plate 50 is lowered, a user may replace the sheets P. When the sheet feed cassette 48 is inserted into the first processing section 10A, the bottom plate 50 is raised under the command of the controller 100.

A feed roller 52 is disposed at an upper end of the sheet feed cassette 48. The feed roller 52 feeds the sheet P from the sheet feed cassette 48 to a transport path 60. The feed roller 52 contacts the uppermost sheet P placed the bottom plate 50. Separation rollers 56 are disposed downstream in the transport direction of the sheet P (hereinafter simply referred to as "downstream") with respect to the feed roller 52. The separation rollers 56 prevent double feeding of the sheet P. Plural pairs of transport rollers 54 are disposed downstream of the separation rollers 56. The transport rollers 54 transport the sheet P downstream.

The transport path 60 is disposed above the sheet feed cassettes 48. The transport path 60 is configured so that the sheet P that has been fed out from the sheet feed cassette 48 is turned around in a first return portion 60A (toward the left side in FIG. 1) and turned around in a second return portion 60B (toward the right side in FIG. 1). The transport path 60 extends to a second transfer portion T2 (described below) located between a second transfer roller 62 and a support roller 42.

An aligner (not shown) is disposed between the second return portion 60B and the second transfer portion T2. The aligner aligns an inclination of the sheet P that is being transported. Positioning rollers 64 are disposed between the aligner and the second transfer portion T2. The positioning rollers 64 adjust the timing at which a toner image is moved on the intermediate transfer belt 34 with the timing at which the sheet P is transported.

An auxiliary path 66 extends from a side surface of the first processing section 10A and merges with the transport path 60 at the second return portion 60B. A sheet P that has been fed out from an external large-volume stacker (not shown), which is disposed adjacent to the first processing section 10A, is transported to the transport path 60 through the auxiliary path 66.

A temperature/humidity sensor 31 is disposed in the first processing section 10A at a position adjacent to an exposure unit 40K. The temperature/humidity sensor 31, which is an example of a measurement unit, measures the temperature and the humidity of the inside of the first processing section 10A. Information on the temperature and the humidity detected by the temperature/humidity sensor 31 is sent to the controller 100.

Plural transporters 70 are disposed downstream of the second transfer portion T2. The transporters 70 transport the sheet P, on which a toner image has been transferred, to the second processing section 10B. The transporters 70 include plural belts looped over driving rollers and driven rollers (not shown). The driving rollers rotate the belts, whereby the sheet P is transported downstream.

A downstream side of one of the transporters 70 extends from the first processing section 10A to the second processing section 10B. The sheet P is transported by the transporter 70, received by a transport device 80 of the second processing section 10B, and transported further downstream. A fixing unit 82 is disposed downstream of the transport device 80. The fixing unit 82 fixes a toner image, which has been transferred to the surface of the sheet P, with heat and pressure.

A transporter 108 is disposed downstream of the fixing unit 82. The transporter 108 transports the sheet P, which has been fed out from the fixing unit 82, downstream. A cooling unit 110 is disposed downstream of the transporter 108. The cooling unit 110 cools the sheet P, which has been heated by the fixing unit 82. The cooling unit 110 includes an upper transport unit 112, a lower transport unit 114, and a cooling portion 120. The upper transport unit 112 and the lower transport unit 114 are respectively disposed on the upper side and on the lower side with the transport path 60 for the sheet P therebetween. The cooling portion 120 includes a heat sink for cooling the sheet P that is being transported.

The upper transport unit 112 includes a heat receiving belt 116 and plural rollers 118. The heat receiving belt 116, which is an endless belt, contacts the image forming surface of the sheet P, absorbs heat of the sheet P, and transports the sheet P. The rollers 118 contact the inner peripheral surface of the heat receiving belt 116 and drive or support the heat receiving belt 116. The heat receiving belt 116 rotates counterclockwise in FIG. 1.

The lower transport unit 114 includes a transport belt 130 and plural rollers 132. The transport belt 130, which is an endless belt, is disposed so that the outer peripheral surface thereof faces the heat receiving belt 116. The transport belt 130 contacts the lower surface of the sheet P, presses the sheet P against the heat receiving belt 116, and transports the sheet P. The rollers 132 contact the inner peripheral surface of the transport belt 130, and drive or support the transport belt 130. The transport belt 130 rotates clockwise in FIG. 1.

A decurling unit 140, which corrects warping of the sheet P, is disposed downstream of the cooling unit 110. Output rollers 198 are disposed downstream of the decurling unit 140. The output rollers 198 output the sheet P, on which an image has been formed thereon, to an output section 196 attached to a side surface of the second processing section 10B. When forming images on both side of the sheet P, the sheet P is transported to a reversing unit 200 that is disposed downstream of the decurling unit 140.

The reversing unit 200 includes a reverse route 202. The reverse route 202 includes a branch path 202A, a sheet transport path 202B, and a reverse path 202C. The branch path 202A branches from the transport path 60. The sheet transport path 202B transports the sheet S, which has been transported through the branch path 202A, toward the first processing section 10A. The reverse path 202C switches back and reverses the sheet P, which is transported through the sheet transport path 202B. Thus, the sheet P, which has been switched back in the reverse path 202C, is transported to the first processing section 10A, enters the transport path 60, which is located above the sheet feed cassettes 48, and transported again to the second transfer portion T2.

Next, the transfer device 30 will be described.

As illustrated in FIG. 1, the transfer device 30 includes the intermediate transfer belt 34, six first transfer rollers 36, a driving roller 38, a tension roller 41, the second transfer roller 62, the support roller 42, and plural support rollers 44. The intermediate transfer belt 34 contacts each of the photoconductors 18 (see FIG. 2). The six first transfer rollers 36 are disposed inside the loop of the intermediate transfer belt 34 and multiple-transfers toner images formed on the photoconductors 18 on the intermediate transfer belt 34. The driving roller 38 is driven by a motor (not shown). The tension roller 41 applies tension to the intermediate transfer belt 34. The second transfer roller 62 transfers a toner image from the intermediate transfer belt 34 to the sheet P. The support roller 42 is disposed so as to face the second transfer roller 62 with the intermediate transfer belt 34 therebetween.

The intermediate transfer belt 34, which is an endless belt, is looped over the six first transfer rollers 36, the driving roller 38, the tension roller 41, the support roller 42, and the plural support rollers 44. The intermediate transfer belt 34 includes six first transfer portion T1 (only one of them is indicated in FIG. 1) and a second transfer portion T2. In each of the first transfer portions T1, the first transfer roller 36 transfers a toner image from the photoconductor 18 to the intermediate transfer belt 34. In the second transfer portion T2, the transferred toner image is transferred from the intermediate transfer belt 34 to the sheet P by the second transfer roller 62. The intermediate transfer belt 34, which holds the toner image on the outer peripheral surface thereof, is rotated by the driving roller 38 in the direction of arrow B (counterclockwise in FIG. 1) from the first transfer portions T1 to the second transfer portion T2.

Each of the first transfer rollers 36 is disposed so as to face a corresponding one of the photoconductors 18 of the image forming units 16 with the intermediate transfer belt 34 therebetween. A power unit (not shown) applies a first transfer bias voltage to the first transfer roller 36. The first transfer bias voltage has a polarity opposite to that of toner. Thus, the toner image formed on the photoconductor 18 is first transferred to the first transfer portion T1 of the intermediate transfer belt 34. A cleaning blade 46 is disposed opposite the driving roller 38 with the intermediate transfer belt 34 therebetween. An edge of the cleaning blade 46 contacts the intermediate transfer belt 34 and removes remaining toner and paper dust from the intermediate transfer belt 34 that is rotating.

A power unit (not shown) applies a second transfer bias voltage to the second transfer roller 62. The second transfer bias voltage has a polarity opposite to that of toner. The second transfer roller 62 and the intermediate transfer belt 34 nip the sheet P therebetween in the second transfer portion T2, and transfers the toner image to the sheet P. Thus, the second transfer roller 62 second transfers the toner images in different colors, which have been multiple-transferred on the intermediate transfer belt 34, to the sheet P that has been transported along the transport path 60.

A position detection unit (not shown) is disposed opposite the outer peripheral surface of the intermediate transfer belt 34. The position detection unit detects markings formed of reflective material on the intermediate transfer belt 34. The position detection unit irradiates a surface of the intermediate transfer belt 34 with light, detects movement of a reference position of the intermediate transfer belt depending on whether the light reflected by the markings is received, and sends the detection information to the controller 100.

Next, setting of the toner concentration and the development bias voltage will be described.

Figure 3:
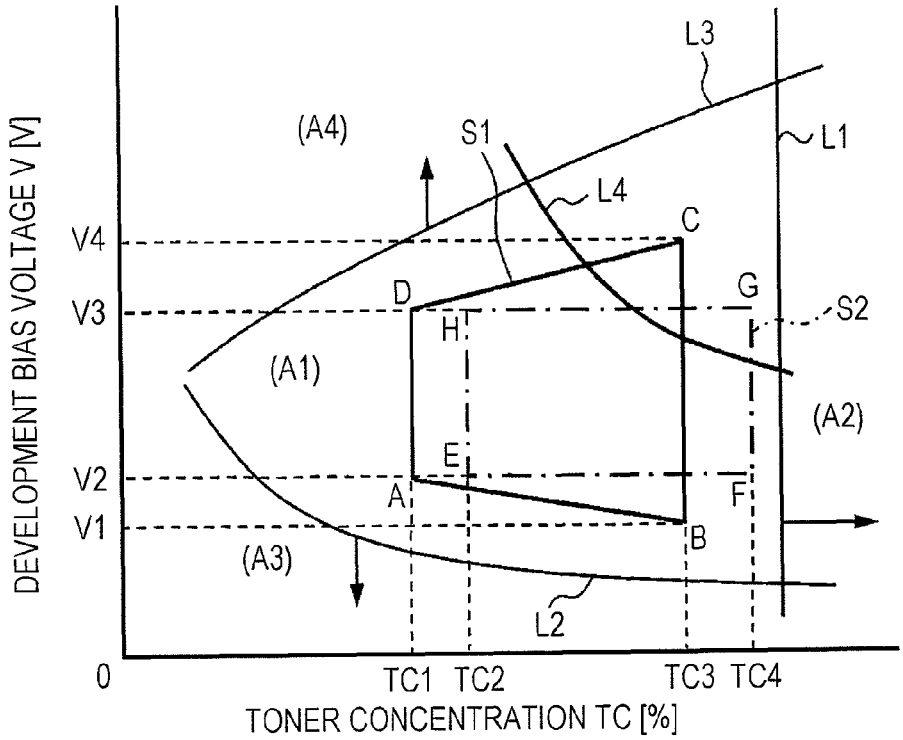
FIG. 3 is a graph illustrating a setting range of the toner concentration and the development bias according to the first exemplary embodiment of the present invention and a comparative example.

FIG. 3 is a graph of the relationship between the toner concentration TC (horizontal axis) and the development bias voltage V (vertical axis). FIG. 3 illustrates the setting range (set value) S1 of the present exemplary embodiment and the setting range (set value) S2 of a comparative example, which are preset in the controller 100. The setting range S1 of the present exemplary embodiment is a trapezoid ABCD. The setting range S2 of the comparative example is a rectangle EFGH. In the comparative example, the development bias voltage V is constant (unchanged) when the toner concentration TC is changed.

In FIG. 3, in a region A2 where the toner concentration TC is higher than the level indicated by a straight line L1, an image defect called fogging tends to occur. Fogging, which is also called a high density background, is a phenomenon that toner adheres to a region on the sheet P (see FIG. 1) that has to be blank. Therefore, the straight line L1 represents the upper limit of the toner concentration TC that is usable.

In the graph of FIG. 3, in a region A3 that is below a curve L2, along which the development bias voltage V decreases as the toner concentration TC increases, deterioration in the reproducibility of a thin line in that a thin line is not clearly transferred to the sheet P or become invisible tends to occur. Therefore, the curve L2 represents the lower limit of the development bias voltage V that is usable.

In the graph of FIG. 3, in a region A4 that is below a curve L3, along which the development bias voltage V increases as the toner concentration TC increases, an image defect called a white spot tends to occur. A white spot occurs when toner does not adhere to a position to which the toner is supposed to adhere to and form an image and, for example, charge is applied to carrier particles when the toner concentration TC is low. In such a case, the carrier particles are developed on the photoconductor 18 to produce a blank area in the image. Therefore, the curve L3 represents the upper limit of the development bias voltage V that is usable.

A region A1, which is surrounded by the straight line L1, the curve L2, and the curve L3, is a setting region of the toner concentration TC and the development bias voltage V. In practice, however, because the toner concentration TC and the development bias voltage V includes measurement errors, the setting range is set so as to be separated from the straight line L1, the curve L2, and the curve L3. The setting range S1 of the present exemplary embodiment and the setting range S2 of the comparative example region A1 are included in the region A1.

For example, the coordinates of the vertices of the setting range S1 (trapezoid ABCD) of the present exemplary embodiment are A(TC1, V2), B(TC3, V1), C(TC3, V4), and D(TC1, V3), when the toner concentration TC is set at TC1<TC2<TC3<TC4 and the development bias is set at V1<V2<V3<V4. The coordinates of the vertices of the setting range S2 (rectangle EFGH) of the comparative example are E(TC2, V2), F(TC4, V2), G(TC4, V3), and H(TC2, V3). In the comparative example, the length of a line segment EH, which represents the setting range of the development bias voltage V for the toner concentration TC2, is equal to the length of a line segment FG, which represents the setting range of the development bias voltage V for the toner concentration TC4. Moreover, the line segment FG is near the straight line L1. The toner concentration TC3 is a set value at which fogging does not occur even when polymerized toner is used in a high-speed machine, and the toner concentration TC4 is a set value at which the fogging may occur when polymerized toner is used although fogging does not occur when pulverized toner is used.

In the setting range S1 of the present exemplary embodiment, the length of a line segment BC, which represents the setting range of the development bias voltage V for the toner concentration TC3, is larger than the length of a line segment AD, which represents the setting range of the development bias voltage V for the toner concentration TC1. Moreover, the line segment BC is farther from the straight line L1 than the line segment FG of the comparative example. In the setting range S1 of the present exemplary embodiment, the upper limit of the development bias voltage V (corresponding to a line segment DC) increases as the toner concentration TC increases. Moreover, the lower limit of the development bias voltage V (corresponding to a line segment AB) decreases as the toner concentration TC increases. That is, in the present exemplary embodiment, the upper limit and the lower limit of the development bias voltage V have inclinations with respect to the toner concentration TC, and are not constant when the toner concentration TC increases as in the comparative example.

In the graph of FIG. 3, a curve L4, which passes the setting range S1 of the present exemplary embodiment and the setting range S2 of the comparative example are illustrated. The curve L4 is a curve on which the product (TC×V) of the toner concentration TC and the development bias voltage V, i.e., the image density is constant. When the image density is constant, control of the toner concentration TC and the development bias voltage V by the controller 100 is performed, for example, along the curve L in the setting ranges S1 and S2. That is, control is performed so as to decrease the development bias voltage V when increasing the toner concentration TC. In FIG. 3, the toner concentration TC and the development bias voltage V are represented by the curve L4 for clarity. In practice, however, the toner concentration TC and the development bias voltage V are determined in a strip-shaped region including the curve L4 with consideration of measurement errors. The curve L4 is set for each image density. For example, a curve L5 illustrated above the curve L4 FIG. 4 represents a higher image density than that of the curve L4.

Next, the operation of the first exemplary embodiment will be described.

First, an image forming process performed by the image forming apparatus 10 will be described.

When the units of the image forming apparatus 10 are operating as illustrated in FIG. 1, image data, which has been image-processed by the controller 100, is converted to color gradation data for each color, and successively output to the exposure units 40. Each of the exposure units 40 emits exposure light L in accordance with the color gradation data for a corresponding color, scans and exposes the photoconductor 18, which has been charged by the charger 20 (see FIG. 2), and forms an electrostatic latent image. The electrostatic latent image, which has been formed on the photoconductor 18 (see FIG. 2), is developed by the developing unit 22, in which the toner concentration TC and the development bias voltage V are set as described below, to form color toner images of the first specific color (V), the second specific color (W), yellow (Y), magenta (M), cyan (C), and black (K).

Next, the color toner images formed on the photoconductors 18 of the image forming units 16V, 16W, 16Y, 16M, 16C, and 16K are successively multiple-transferred to the intermediate transfer belt 34 by the six first transfer rollers 36V, 36W, 36Y, 36M, 36C, and 36K. The color toner images, which have been multiple-transferred to the intermediate transfer belt 34, are second transferred by the second transfer roller 62 to the sheet P, which has been transported from the sheet feed cassette 48. The sheet P, on which the toner images have been transferred, is transported by the transporters 70, to the fixing unit 82, which is disposed in the second processing section 10B.

Next, the color toner images on the sheet P are fixed on the sheet P by being heated and pressed by the fixing unit 82. The sheet P, on which the toner image has been fixed, passes the cooling unit 110. In the cooling unit 110, the sheet P is transported while being nipped between the heat receiving belt 116 and the transport belt 130, and the cooling portion 120 cools the sheet P. The sheet P, which has been cooled, is transported to the decurling unit 140, and warping of the sheet P is corrected. The sheet P, whose warping has been corrected, is output to the output section 196 by the output rollers 198.

When forming an image on a surface on which the image has not been formed (in the case of duplex printing), a switching member (not shown) transports the sheet P, on which the image has been formed on the front surface thereof, is transported to the reversing unit 200. The sheet P, which has been transported to the reversing unit 200, is reversed while the sheet P passes through the reverse route 202, and transported to the transport path 60 above the sheet feed cassette 48. Then, toner images are formed on the back surface with the same process as described above, the toner images are fixed and cooled, and then the sheet P is output to the output section 196.

Next, setting of the toner concentration and the development bias when forming an image will be described.

Figure 4:
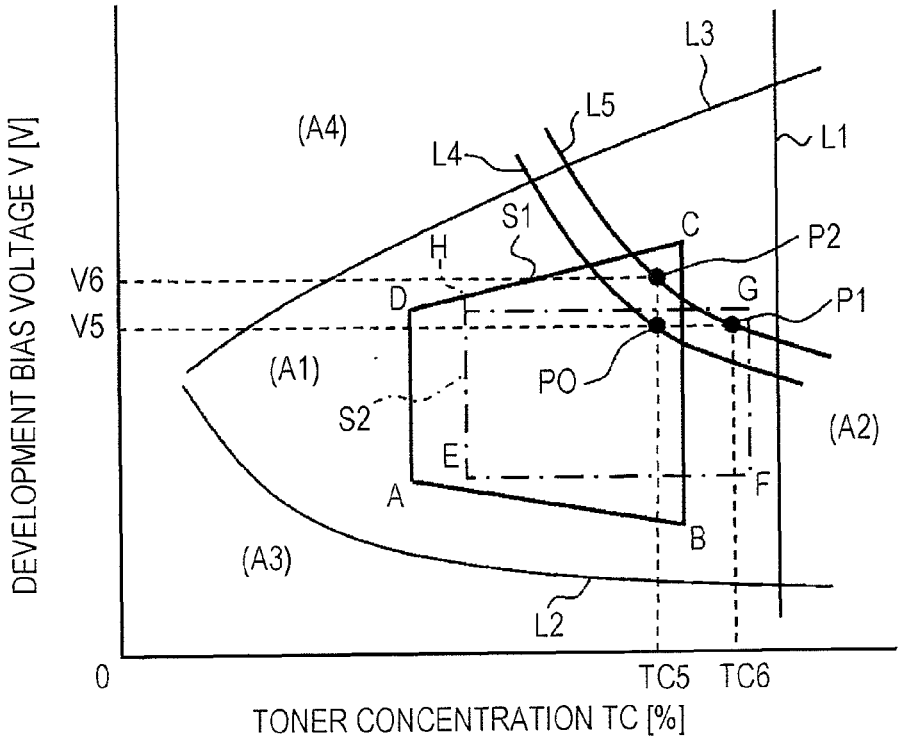
FIG. 4 is a graph illustrating set values of the toner concentration and the development bias in the setting range according to the first exemplary embodiment of the present invention and set values of the toner concentration and the development bias in the setting range according to the comparative example.

In the graph of FIG. 4, a point P0(TC5, V5), for example, represents set values of the toner concentration TC and the development bias voltage V of the image forming apparatus 10. The controller 100 (see FIG. 1) changes the toner concentration TC and the development bias voltage V along the curve L4. Here, V2<V5<V3, and V5 is close to V3.

Suppose that the setting range of the image toner concentration TC and the development bias voltage V is the setting range S2 of the comparative example. When the controller 100 receives a command from an operation panel (not shown) of the image forming apparatus 10 to increase the concentration of a toner image and the controller 100 attempts to increase the development bias voltage V by shifting from the curve L4 to the curve L5, the development bias voltage V exceeds the upper limit. Therefore, in order to increase the toner concentration TC in the comparative example, control is performed so as to change the set values from the point P0 on the curve L4 to a point P1(TC6, V5) on the curve L5, where TC6>TC5 and V5<V6.

However, because the point P1 is close to the straight line L1, which is the upper limit of the toner concentration TC, fogging may occur with consideration of an error. Thus, with the setting range S2 of the comparative example, which is a rectangle where the upper limit is constant, it is difficult to increase the development bias voltage V along the curve L4. Therefore, it is necessary to increase the toner concentration TC, which causes fogging.

On the other hand, suppose that the setting range of the image toner concentration TC and the development bias voltage V is the setting range S1 of the present exemplary embodiment. When the controller 100 receives a command from an operation panel (not shown) of the image forming apparatus 10 to increase the concentration of a toner image, the controller 100 may increase the development bias voltage V by shifting from the curve L4 to the curve L5, because, in the setting range S1, the range of the development bias voltage V close to the upper limit is wider than that of the setting range S2 of the comparative example. For example, control may be performed so as to change the set value from the point P0 on the curve L4 to the point P2 (TC5, V6) on the curve L5, where V6>V5. As a result, the image density may be increased by increasing the development bias voltage V from V5 to V6 without increasing the toner concentration TC from TC5 to TC6.

Therefore, when the setting range S1 of the present exemplary embodiment is used, flexibility in the choice of the toner concentration TC and the development bias voltage V (a range in which setting of the development bias voltage V may be changed without increasing the toner concentration TC) is provided, whereby the setting of the toner concentration TC and the development bias voltage V is flexibly changed. Thus, the density of the toner image may be increased without increasing the toner concentration TC, and occurrence of fogging is reduced as compared with the comparative example.

In the present exemplary embodiment, in the setting range S1, the lower limit of the development bias voltage V decreases as the toner concentration TC increases. In other words, the lower limit of the development bias voltage V increases as the toner concentration TC decreases. Thus, the lower limit of the development bias voltage V in the setting range S1 is separated from the curve L2, which represents the threshold for the reproducibility of a thin line, whereby the reproducibility of a thin line is maintained.

The toner concentration TC (%) and the charge of the toner (μC/g) are inversely correlated, and the charge of the toner increases as the toner concentration TC decreases. In the present exemplary embodiment, the lower limit of the toner concentration TC (for example, the point A) is lower than the lower limit of the toner concentration TC of the comparative example (for example, the point E). Therefore, the toner concentration TC may be made lower than that of the comparative example in a range in which the toner concentration TC is low. Therefore, an image defect caused by the shortage of charge of the toner (for example, scattering of toner with a low charge) is suppressed.

When the toner concentration TC is reset (for example, the curve L5 in FIG. 4 is set) so as to increase the toner concentration TC in the image forming apparatus 10 illustrated in FIGS. 1 and 2, the controller 100 makes the dispenser supply toner to supply toner and rotate the augers 23 so that the toner concentration reaches a target. When the development bias voltage V is reset, the controller 100 changes the output voltage of the voltage applying section 27. The toner concentration TC and the development bias voltage V of the developing unit 22 are thus controlled.

Next, an example of an image forming apparatus according to a second exemplary embodiment of the present invention will be described.

The image forming apparatus according to second exemplary embodiment has the same mechanical structure as that of the image forming apparatus 10 according to the first exemplary embodiment. The second exemplary embodiment differs from the first exemplary embodiment in the setting range of the toner concentration TC and the development bias voltage V in the controller 100. Therefore, the image forming apparatus according to the second exemplary embodiment will be referred to as the image forming apparatus 10. Members the same as those of the image forming apparatus 10 according to the first exemplary embodiment will be described by using the same numerals, and description of such members will be omitted.

In the second exemplary embodiment, the setting range (set value) S1 of the toner concentration TC and the development bias voltage V of the first exemplary embodiment is a setting range for a normal temperature and normal humidity condition (for example, 22° C. and 55%). A setting range S3 for a high-temperature and high-humidity condition and a setting range S4 for a low-temperature and low-humidity condition are also set in the controller 100. An example of a high-temperature and high-humidity condition is 28° C. and 85%, and an example of a low-temperature and low-humidity condition is 10° C. and 15%.

Figure 5:
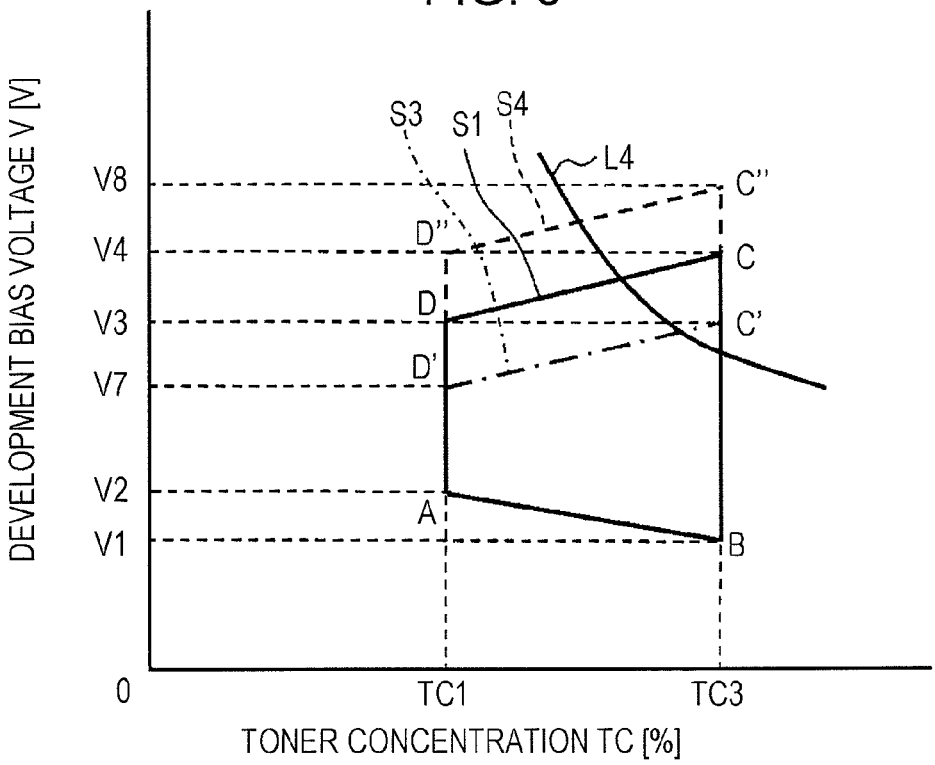
FIG. 5 is a graph illustrating a setting range of the toner concentration and the development bias according to a second exemplary embodiment of the present invention.

As illustrated in FIG. 5, the setting range S3 is represented by a trapezoid ABC'D', and the setting range S4 is represented by a trapezoid ABC"D". In the setting ranges S3 and S4, the upper limit of the toner concentration TC is TC3, and the lower limit of the toner concentration TC is TC1, which are the same as those of the setting range S1. In the setting ranges S1, S3, and S4, the lower limits of the development bias voltage V are the same. The upper limits of the development bias voltage V become larger in the order of S1, S3, and S4. The coordinates of the vertices the trapezoids are C'(TC3, V3), C"(TC3, V8), D'(TC1, V7), D"(TC1, V4), where the development bias voltages V2<V7<V3<V4<V8. The setting range S3 for the high-temperature and high-humidity condition is the smallest, because toner particles absorb moisture and are easily charged in such a condition.

Next, the operation of the second exemplary embodiment will be described.

If the temperature/humidity sensor 31 (see FIG. 1) detects at least one of a temperature 28° C. or a humidity 85%, the controller 100 changes the setting range of the toner concentration TC and the development bias voltage V from S1 to S3. Thus, the upper limit of the development bias voltage V is decreased, and an excessive development bias is applied to the development roller 22B.

If the temperature/humidity sensor 31 (see FIG. 1) detects at leas one of the temperature of 10° C. and the humidity of 15%, the controller 100 changes the setting range of the toner concentration TC and the development bias voltage V from S1 to S4. Thus, the upper limit of the development bias voltage V is increased, and the development bias voltage V that is higher than a normal value may be applied to the development roller 22B. Therefore, when the environmental condition changes, the toner concentration TC and the development bias voltage V are selected in accordance with the changed environmental condition, whereby an appropriate density of a toner image is obtained.

The setting ranges S3 and S4 of the present exemplary embodiment are larger than the setting range S2 of the comparative example (see FIG. 3). Therefore, flexibility in the choice of the toner concentration TC and the development bias voltage V is provided, and the setting of the toner concentration TC and the development bias voltage V is flexibly changed. In the present exemplary embodiment, it is not necessary to increase the toner concentration TC when increasing the concentration of a toner image. Therefore, occurrence of fogging is suppressed as compared with the comparative example. Moreover, in the present exemplary embodiment, in the setting ranges S3 and S4, as the toner concentration TC increases, the lower limit of the development bias voltage V decreases. In other words, as the toner concentration TC decreases, the lower limit of the development bias voltage V increases. Thus, the lower limit of the development bias voltage V in the setting ranges S3 and S4 is separated from the curve L2 (see FIG. 3), which represents the threshold for the reproducibility of a thin line, whereby the reproducibility a thin line is maintained.

Next, an example of an image forming apparatus according to a third exemplary embodiment of the present invention will be described.

The image forming apparatus according to the third exemplary embodiment has the same mechanical structure as that of the image forming apparatus 10 according to the first exemplary embodiment. The third exemplary embodiment differs from the first embodiment in the setting range of the toner concentration TC and the development bias voltage V in the controller 100. Therefore, the image forming apparatus according to the third exemplary embodiment will be referred to as the image forming apparatus 10. Members the same as those of the image forming apparatus 10 according to the first exemplary embodiment will be described by using the same numerals, and description of such members will be omitted.

In the third exemplary embodiment, the setting range (set value) S1 of the toner concentration TC and the development bias voltage V of the first exemplary embodiment is a setting range for an initial state in which the number of images formed is small. A setting range S5, which is a setting range for a time-elapsed state in which the time spent for forming images or the number of images formed has exceeded a predetermined value, is also set in the controller 100.

Figure 6:
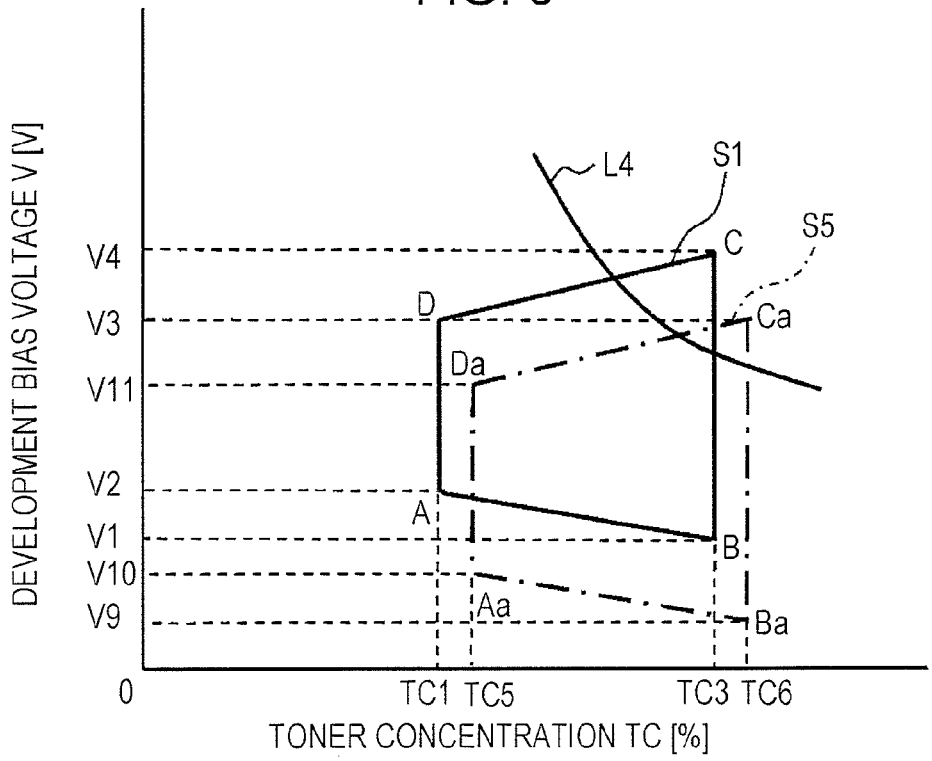
FIG. 6 is a graph illustrating a setting range of the toner concentration and the development bias according to a third exemplary embodiment of the present invention.

As illustrated in FIG. 6, the setting range S5 is represented by a trapezoid AaBaCaDa. In the setting range S5, the upper limit of the toner concentration TC is TC6 (>TC3), and the lower limit of the toner concentration TC is TC5 (>TC1). The upper limit and the lower limit of the development bias are lower than those for the setting range S1. The coordinates of the vertices of the setting range S5 are Aa(TC5, V10), Ba(TC6, V9), Ca(TC6, V3), and Da(TC5, V11), where the development bias voltages V9<V10<V1<V2<V11<V3<V4).

Next, the operation of the third exemplary embodiment will be described.

When the time spent for forming images or the number of images formed, which is detected by the controller 100, exceeds a predetermined value, the controller 100 changes the setting range of the toner concentration TC and the development bias voltage V from S1 to S5. Therefore, the upper limit and the lower limit of the development bias voltage V are decreased, whereby an excessive development bias voltage V is not applied to the development roller 22B. Thus, the toner concentration TC and the development bias voltage V are selected in accordance with the stage of use, so that a desired density of the toner image is obtained.

The setting range S5 of the present exemplary embodiment is larger than the setting range S2 of the comparative example (see FIG. 3). Therefore, flexibility in the choice of the toner concentration TC and the development bias voltage V is provided, and the setting of the toner concentration TC and the development bias voltage V is flexibly changed. In the present exemplary embodiment, it is not necessary to increase the toner concentration TC when increasing the concentration of a toner image. Therefore, occurrence of fogging is suppressed as compared with the comparative example. Moreover, in the present exemplary embodiment, in the setting range S5, as the toner concentration TC increases, the lower limit of the development bias voltage V decreases. In other words, as the toner concentration TC decreases, the lower limit of the development bias voltage V increases. Therefore, the lower limit of the development bias voltage V in the setting range S5 is separated from the curve L2 (see FIG. 3), which represents the threshold for the reproducibility of a thin line, whereby the reproducibility of a thin line is maintained.

Next, an example of an image forming apparatus according to a fourth exemplary embodiment of the present invention will be described.

The image forming apparatus according to the fourth exemplary embodiment has the same mechanical structure as that of the image forming apparatus 10 according to the first exemplary embodiment. The fourth exemplary embodiment differs from the first embodiment in the setting range of the toner concentration TC and the development bias voltage V in the controller 100. Therefore, the image forming apparatus according to the fourth exemplary embodiment will be referred to as the image forming apparatus 10. Members the same as those of the image forming apparatus 10 according to the first exemplary embodiment will be described by using the same numerals, and description of such members will be omitted.

In the fourth exemplary embodiment, the setting range S1 of the toner concentration TC and the development bias voltage V in the first exemplary embodiment is a setting range for yellow (Y) toner and magenta (M) toner. A setting range (set value) S7 for black (K) toner and a setting range (set value) S6 for cyan (C) toner are also set in the controller 100.

Figure 7:
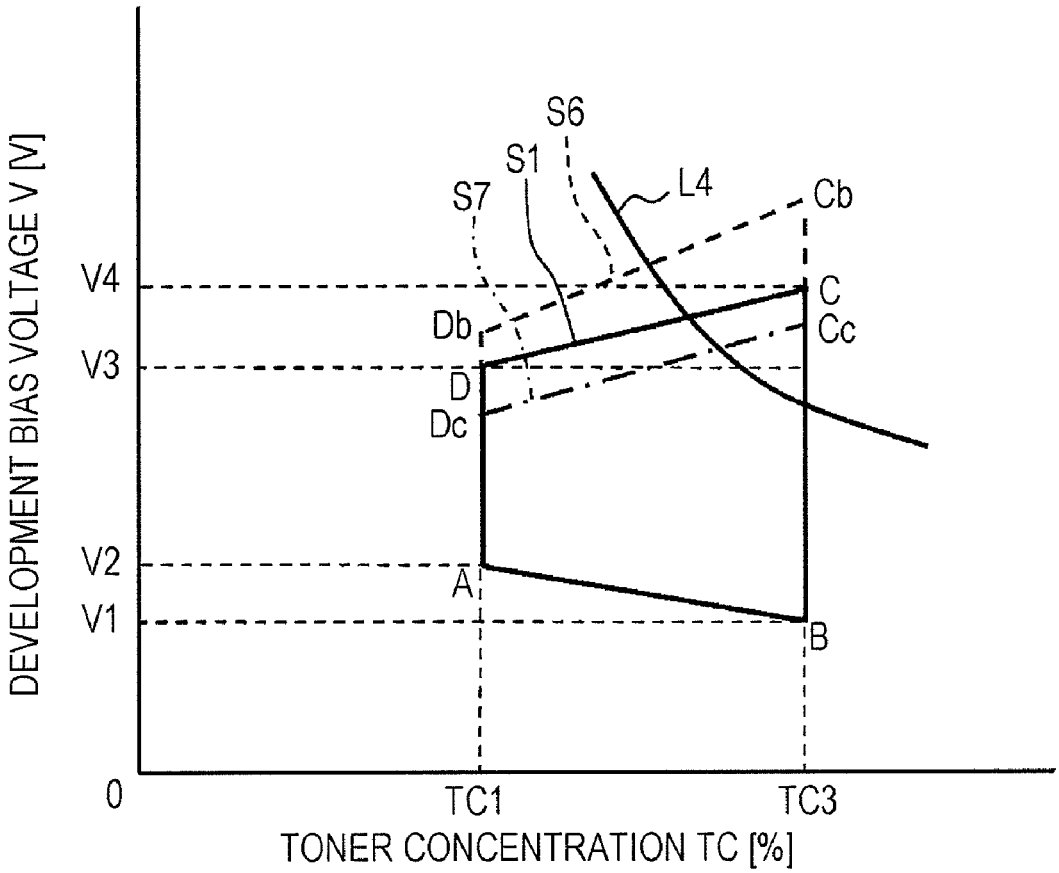
FIG. 7 is a graph illustrating a setting range of the toner concentration and the development bias according to a fourth exemplary embodiment of the present invention.

As illustrated in FIG. 7, the setting range S6 is represented by a trapezoid ABCbDb, and the setting range S7 is represented by a trapezoid ABCcDc. In the setting ranges S6 and S7, the upper limit of the toner concentration TC is TC3, and the lower limit of the toner concentration Tc is TC1, which are the same as those of the setting range S1. The lower limit of the development bias voltage V is the same for the setting ranges S1, S6, and S7, and the upper limit of the development bias voltage V increases in the order of S7, S1, and S6. For the setting ranges S1, S6, and S7, the slopes of the line segments DC, DbCb, and DcCc, which represent the upper limits of the development bias voltage V, are denoted by $\alpha$, $\beta$, and $\gamma$ (not shown), respectively. Then, $\alpha<\gamma<\beta$ in the present exemplary embodiment. For example, because the coordinates of the end points C and D are respectively (TC3, V4) and (TC1, V3) for the line segment DC, the equation representing the line segment DC is $V=\alpha\times(TC-TC1)+V3$, where TC is the toner concentration, and V is the development bias voltage, and $\alpha$ is the slope. The equation may be rewritten as $\alpha=(V4-V3)/(TC3-TC1)$.

Next, the operation of the fourth exemplary embodiment will be described.

In the image forming apparatus 10, the controller 100 sets a setting range S1 for yellow (Y) toner and magenta (M) toner, a setting range S7 for cyan (C) toner, and a setting range S6 for black (K) toner as the setting ranges of the toner concentration TC and the development bias voltage V for the developing unit 22. Thus, the toner concentration TC and the development bias voltage V are selected and set in accordance with the characteristic of the toner, whereby a desired density of a toner image is obtained.

The setting ranges S6 and S7 of the present exemplary embodiment is larger than the setting range S2 (see FIG. 3) of the comparative example described above. Therefore, flexibility in the choice of the toner concentration TC and the development bias voltage V is provided, and the setting of the toner concentration TC and the development bias voltage V is flexibly changed. With the present exemplary embodiment, it is not necessary to increase the toner concentration TC in order to increase the density of a toner image. Therefore, occurrence of fogging is suppressed as compared with the comparative example. With the present exemplary embodiment, in the setting ranges S6 and S7, as the toner concentration TC increases, the lower limit of the development bias voltage V decreases. In other words, as the toner concentration TC decreases, the lower limit of the development bias voltage V increases. Therefore, the lower limit of the development bias voltage V in the setting ranges S6 and S7 is separated from the curve L2 (see FIG. 3), which represents the threshold for the reproducibility of a thin line, whereby the reproducibility of a thin line is maintained.

The present invention is not limited to the exemplary embodiments described above.

The shape of the setting range of the toner concentration TC and the development bias voltage V is not limited to a trapezoid. For example, the upper limit or the lower limit may change along a curve. One of the upper limit and the lower limit of the development bias voltage V may be changed in accordance with the increase in the toner concentration TC, and the other of the upper limit and the lower limit need not be changed.

Both the setting ranges S3 and S4 and the setting range S5 may be set, so as to deal with a change in temperature and humidity and a time-dependent change. The setting ranges of the toner concentration TC and the development bias voltage V need not be preset in the controller 100. Instead, the upper limit of the development bias voltage V may be estimated on the basis of detected data for the toner concentration TC and the development bias voltage V, and the estimated data may be used for the image forming operations that follow.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image holder that holds a latent image;

a developing unit that contains developer including toner particles and carrier particles, develops a latent image with the toner particles, and forms a toner image;

a voltage applying unit that applies a voltage to the developing unit;

a toner concentration detection unit that detects a toner concentration that is a proportion of the toner particles to the developer contained in the developing unit; and a setting unit that sets a setting value of the voltage on the basis of the toner concentration detected by the toner concentration detection unit, the voltage being applied by the voltage applying unit to the developing unit, wherein a difference between an upper limit and a lower limit of the set value increases as the toner concentration increases, the set value being set by the setting unit.

2. The image forming apparatus according to claim 1, wherein the setting unit is configured to increase the upper limit of the set value as the toner concentration increases.

3. The image forming apparatus according to claim 2, further comprising:

a measurement unit that measures at least one of temperature and humidity, wherein the setting unit changes the set value in accordance with at least one of the temperature and the humidity that is measured by the measurement unit while maintaining a setting with which the difference between the upper limit and the lower limit of the set value increases.

4. The image forming apparatus according to claim 2, wherein the setting unit changes the set value on the basis of a time spent for forming images or the number of images formed while maintaining a setting with which the difference between the upper limit and the lower limit of the set value increases.

5. The image forming apparatus according to claim 2, further comprising:

a plurality of the developing units including toner particles of different characteristics, wherein the setting unit sets the set value for each of the plurality of the developing units.

6. The image forming apparatus according to claim 1, further comprising:

a measurement unit that measures at least one of temperature and humidity, wherein the setting unit changes the set value in accordance with at least one of the temperature and the humidity that is measured by the measurement unit while maintaining a setting with which the difference between the upper limit and the lower limit of the set value increases.

7. The image forming apparatus according to claim 1, wherein the setting unit changes the set value on the basis of a time spent for forming images or the number of images formed while maintaining a setting with which the difference between the upper limit and the lower limit of the set value increases.

8. The image forming apparatus according to claim 1, further comprising:

a plurality of the developing units including toner particles of different characteristics, wherein the setting unit sets the set value for each of the plurality of the developing units.

* * * * *